US005480319A

United States Patent [19]

Vlakancic

[11] Patent Number: 5,480,319

[45] Date of Patent: Jan. 2, 1996

[54] ELECTRICAL CONNECTOR LATCHING APPARATUS

[76] Inventor: Constant G. Vlakancic, 150 Jackson St., Los Gatos, Calif. 95032

[21] Appl. No.: 176,546

[22] Filed: Dec. 30, 1993

[51] Int. Cl.[6] ..... H01R 4/50

[52] U.S. Cl. ..... 439/347; 439/490; 439/923

[58] Field of Search ..... 439/76, 347, 350, 439/488, 489, 490, 188, 911, 923; 200/51 R, 330, 332.1

[56] References Cited

U.S. PATENT DOCUMENTS

| | | | |
|---|---|---|---|
| 3,960,428 | 6/1976 | Naus et al. | 439/490 X |
| 4,379,606 | 4/1983 | Clark et al. | 439/490 X |
| 4,969,830 | 11/1990 | Daly et al. | 439/347 X |
| 5,135,410 | 8/1992 | Kawase et al. | 439/489 X |
| 5,222,164 | 6/1993 | Bass, Sr. et al. | 439/490 X |

FOREIGN PATENT DOCUMENTS

| | | | |
|---|---|---|---|
| 2126805 | 3/1984 | United Kingdom | 439/911 |

OTHER PUBLICATIONS

IBM Technical Disclosure Bulletin, vol. 36 No. 12, Dec. 1993.

*Primary Examiner*—Khiem Nguyen
*Attorney, Agent, or Firm*—Robert Buckley

[57] ABSTRACT

A latching apparatus for interlocking electrical connectors such as the Ethernet® compliant 15-pin D-shell AUI connector. The latching apparatus is made a part of the male AUI connector, and includes a key for engaging and operating the locking member of the female AUI connector. The key can be incorporated into any device or mating connector which attaches to the AUI connector of an Ethernet® LAN adapter. The key is operated by hand and in one embodiment is coupled to a switch for modifying an Ethernet® signal to indicate whether the lock is in the locked or in the unlocked position.

26 Claims, 3 Drawing Sheets

ELECTRICAL CONNECTOR LATCHING APPARATUS

FIELD OF THE INVENTION

The invention relates to electrical connectors and in particular to latching electrical connectors.

BACKGROUND OF THE INVENTION

Desktop and personal computers have become extremely common in the workplace and in the home. Experience has shown that the power of individual computers can be increased manyfold by forming networks of interconnected computers. One popular interconnection networking style or discipline is the LAN or "local area network" in which personal computers and workstations are interconnected so that they may easily communicate with one another or share a common resource such as a printer, hard disk or the like.

The art of computer networking has evolved to a point where standardized hardware and software modules may be purchased "off the shelf" to simplify the interconnection problem. One popular discipline is the "Ethernet®" in which computers are interconnected using LAN Adaptors and related equipment.

A set of interfacing standards has arisen surrounding the use of such adaptors. These standards regulate both the electrical and the mechanical connections which can be used within the Ethernet® standard. In the IEEE ("Institute of Electrical and Electronics Engineers")802.3 Standard, some of the interconnection is accomplished using a pair of 15-pin D-shell mating male and female connectors which are capable of being mechanically interlocked to prevent accidental separation of the network connection.

The Ethernet® AUI 802.3 compliant 15-pin, D-shell female connector includes a sliding lock (see FIG. 1) which can engage locking posts on the mating male connector. These female connectors are used on Ethernet® devices such as the LAN Adapter Card, the Bridge, the Router and the like. These devices are a common part of the Ethernet® network for interconnected computers and workstations. The mating male connectors are typically used on AUI compliant drop cables and the micro transceiver, such as that depictea in FIG. 1.

The AUI 802.3 compliant connectors (hereafter "AUI connectors") are mated for interconnection by sliding the lock of the female connector to an unlocked position so that the male connector can be inserted into the female connector. Once the male connector has been inserted, the lock of the female connector is slid to a locked position, thereby engaging the locking posts on the male connector. Once locked, the two connectors are not easily separated and so are unlikely to become accidentally disconnected.

One serious difficulty with the sliding locking mechanism of the AUI connectors is that the female connector is frequently located at the backside of the computer equipment. Located away from ready visual and physical access, the sliding lock is difficult to operate because of its inaccessibility. Typically, the sliding lock is operated to slide between the locked and the unlocked positions, and vice versa, by awkwardly reaching behind the equipment and using the fingers, or some tool such as a screwdriver or the like, to operate the locking mechanism. It becomes necessary to rely upon a sense of feel, made more difficult once the connectors are mated. It is sometimes difficult to determine whether the sliding locking mechanism has properly engaged the locking posts of the male connector.

Alternatively, the equipment must be partially rotated in place to permit access to the female connector at the rear of the equipment. Moving the equipment runs the risk of disturbing the various cables used to interconnect the computer with other devices. Neither alternative is particularly attractive. What is needed is some way to operate the sliding lock by hand in an easy-to-use, secure manner which does not rely on a well developed sense of touch or use of an ad hoc tool such as a screwdriver.

It is useful to provide the computer system with an electrical signal which can be used to indicate whether the locking mechanism is properly engaged. Such a signal permits the system designer to incorporate a warning which can be displayed to the computer operator or sound an audible alarm when the AUI network connectors are not properly locked.

It is also useful to provide a visual indication that the locking mechanism has properly engaged the locking posts. Though such a visual indication may be accessible from near the connector only, it can be made visible more easily than a direct view of the locking mechanism.

SUMMARY OF THE INVENTION

It is an object of the present invention to provide a manually operated mechanism for operating an interlock of interlocking, mating electrical connectors.

It is an object of the present invention to provide such a manually operated mechanism which is an integral part of the mated connectors so that supplemental tools are not required to operate the interlock.

It is also an object of this invention to provide an electrical signal coupled to the interlock for use in generating a system status signal or providing an audible alarm indicating whether the interlock is locked or is unlocked.

It is an additional object of the present invention to provide an easily observed visual indication that the interlock is either locked or is unlocked.

In accordance with the above objects and those that will be mentioned and will become apparent below, an electrical connector latching apparatus for use with a pair of mating electrical connectors, the connectors including an interlock, the interlock having a locked position for preventing separation of the connectors when mated and having an unlocked position for allowing separation and mating, the interlock being operable between the locked and the unlocked positions, the apparatus is provided, comprising:

a key, the key including:

operation means for engaging the interlock and for operating the interlock between the locked and the unlocked positions; and support means for supporting the operation means relative to at least one of the connectors.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
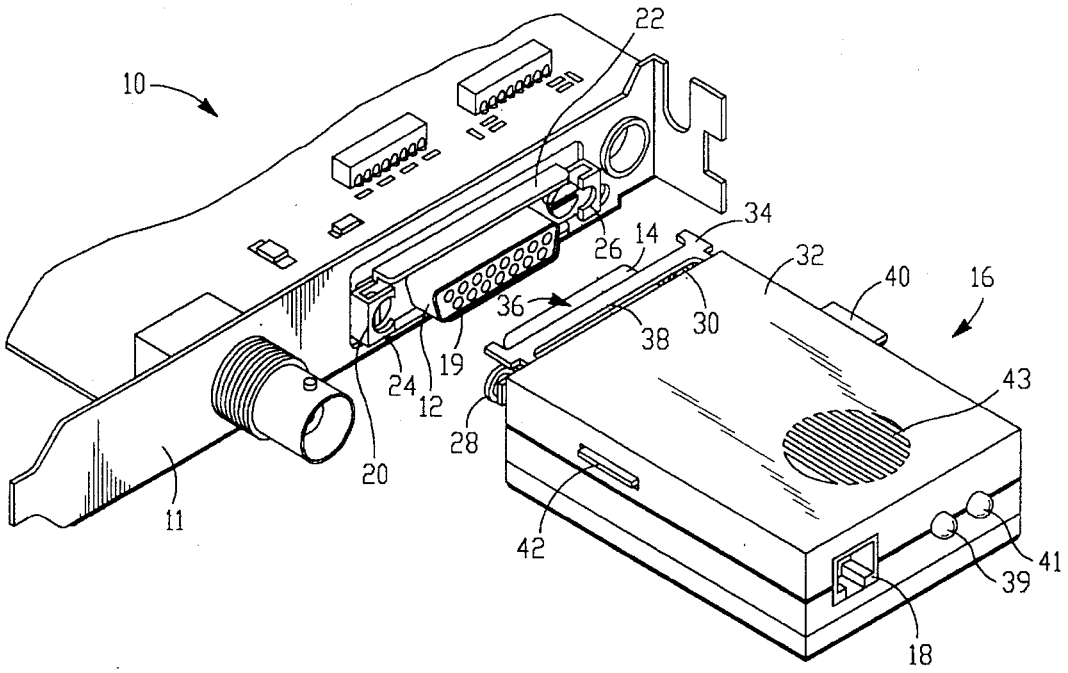
FIG. 1 is a partial perspective view of the latching apparatus according to the present invention.

FIG. 1 illustrates a typical Ethernet® LAN adapter card 10 including a female AUI connector 12 for mating with the male AUI connector of a device such as a micro transceiver 16. The micro transceiver 16 includes an additional connector 18 for connection with a cable of a local area network.

The female AUI connector 12 is shown attached to a bracket 11 of the LAN adapter card 10. Connector 12 includes female connector receptacles 19, a sliding lock 20 having a stiffening member 22 and locking post engagement members 24 and 26.

The mating male AUI connector 14 includes a pair of locking posts 28 and 30. Locking post 30 is partially hidden from view.

The micro transceiver 16 includes an enclosure 32, a sliding key 34 having a recess 36, a guide slot 38, opposed key operating tabs 40 and 42, Ethernet® network status LED indicators 39 and 41, and an audible alarm 43.

The sliding lock 20 illustrated in FIG. 1 is slidable between an unlocked position and a locked position. The sliding lock 20 is illustrated in the unlocked position in FIG. 1. In the unlocked position, the locking post engagement members 24 and 26 permit passage of the locking posts 28 and 30 of the mating male AUI connector 14 for compatible interconnection of the female 12 and the male 14 AUI connectors.

Figure 2:
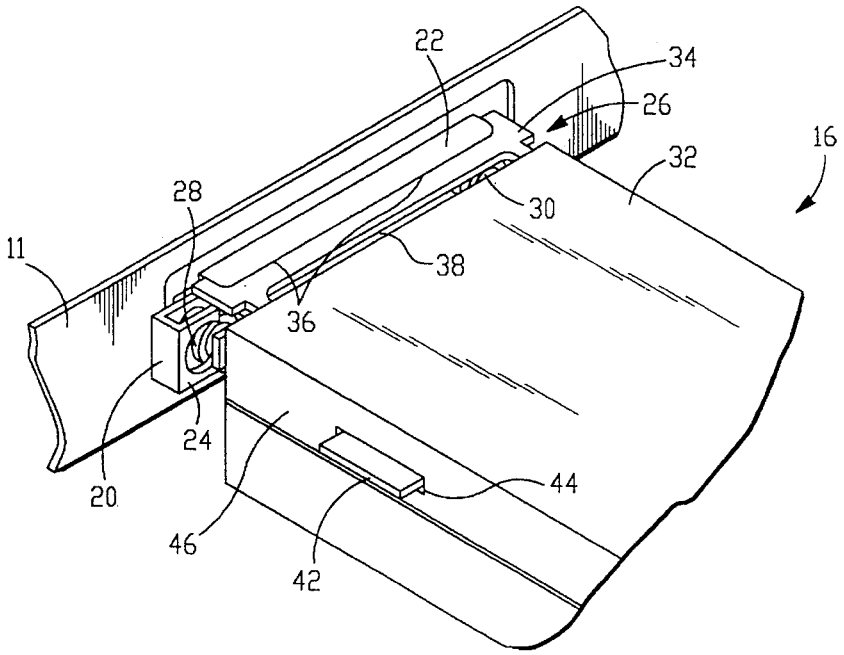
FIG. 2 is a partial perspective view of the latching apparatus of FIG. 1, showing mated connectors in the locked position.

When the micro transceiver 16 is attached to the AUI connector 12 of the LAN adapter card 10, the recess 36 of the sliding key 34 is positioned to engage the stiffening member 22 of the sliding lock 20, as illustrated in the partial perspective view of FIG. 2. The elements illustrated in FIG. 2 are shown in FIG. 1 and have the same numerals. These elements include the bracket 11, the sliding lock 20, the stiffening member 22, the locking post engaging member 24, the locking posts 28 and 30, the enclosure 32 of the micro transceiver 16, the recess 36, the guiding slot 38, and one key operating tab 42. Also shown in FIG. 2 is a slot 44 in one side 46 of the enclosure 32. Though not illustrated in the perspective view, the opposing side of the enclosure 32 includes a similar slot.

The sliding lock 20 is slidable in the plane of the bracket 11 and in the long direction of the female AUI connector 12 (from left to right as illustrated in FIGS. 1, 2). The key 34 is slidable within the enclosure 32 in the plane of the stiffening member 22 (also from left to right as illustrated in FIGS. 1, 2). The opposed key operating tabs 40 and 42 extend through the slots at the sides of the enclosure 32 and are used to position the recess 36 of the key 34 for engagement with the stiffening member 22. The opposed key operating tabs 40, 42 can be grasped between thumb and forefinger of one hand for sliding the key 34 from side to side. Once the recess 36 engages the stiffening member 22, the key 34 can be slid from side to side to move the sliding lock 20 between the locked and the unlocked positions.

The sliding lock 20 is shown in the locked position in FIG. 2. In the locked position, the locking post engaging members 24 and 26 engage recesses of the locking posts 28 and 30, respectively. The locking posts 28 and 30 have a smaller diameter at the recess, and thus when the sliding lock 20 is in the locked position, the locking post engaging members 24 and 30 prevent disconnection of the mated female and male AUI connectors 12 and 14.

Figure 3:
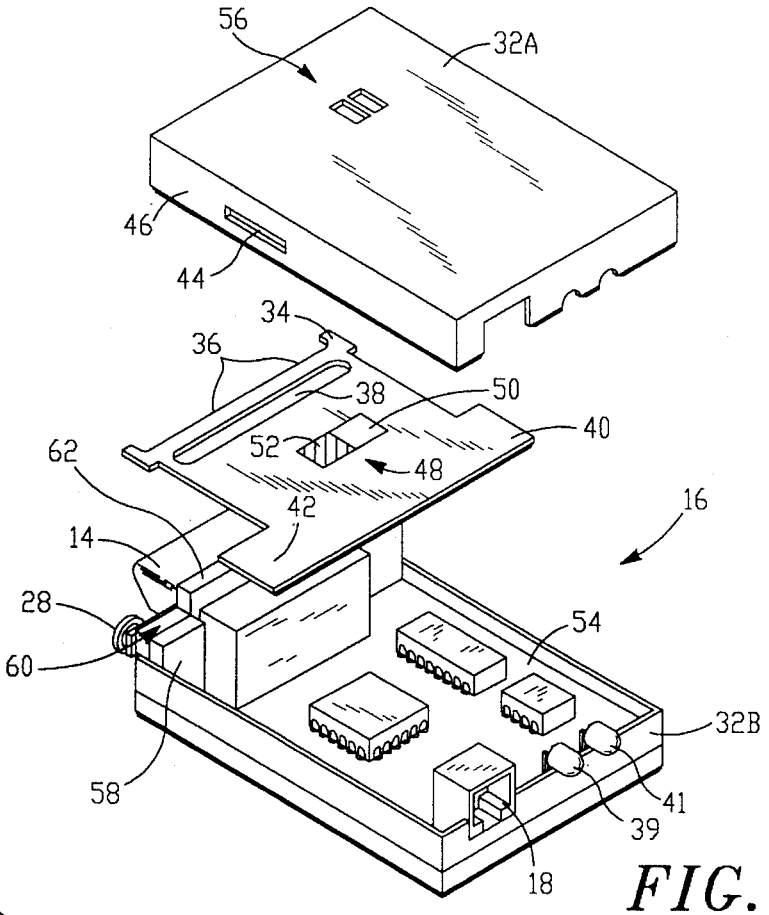
FIG. 3 is an exploded, perspective view illustrating a single piece key and enclosure according to the present invention.

With particular respect to FIG. 3, there is shown an exploded perspective view of the Ethernet® micro transceiver 16. The micro transceiver 16 includes an enclosure 32 having upper and lower portions 32A and 32B respectively, a sliding key 34, a male AUI connector 14, a circuit card 54, an additional connector 18, and a locking post 28.

The upper portion 32A of the enclosure 32 includes a side 46 having a slot 44. An opposing side includes a similar slot and is not shown in the perspective view of FIG. 3. The upper portion 32A also includes an opening 56.

The sliding key 34 includes a recess 36, a guide slot 38, opposed key operating tabs 40 and 42, and a visual indicator 48 having reflective 50 and non-reflective 52 regions.

The lower portion 32B includes the circuit card 54, the male AUI connector 14, the additional connector 18, and the LED indicators 39 and 41. The male AUI connector 14 includes a base member 58 having a portion 60 removed at opposed corners to create a guide 62.

When assembled, the sliding key 34 sits on top of the male AUI connector 14. The guide slot 38 of the sliding key 34 fits over the guide 62. Slot 38 has a length slightly greater than the length of the guide 62, permitting the sliding key 34 to move from side to side a sufficient distance to operate the sliding lock 20 of the female AUI connector 12 between the locked and the unlocked positions. The opposed operating tabs 40, 42 extend through slots,44 in opposed sides 46 of the upper portion 32A of the enclosure 32. The reflective 50 and non-reflective 52 regions of the visual indicator 48 are alternatively visible through the opening 56 as the key 34 is slid from side to side between the locked and the unlocked positions.

Figure 4:
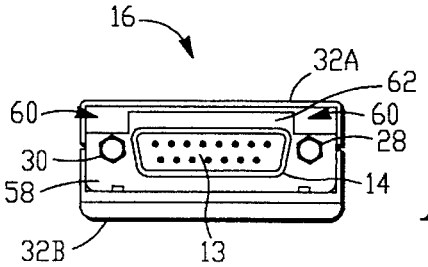
FIG. 4 is a front view of the enclosure of FIG. 3, illustrating a modification of the male AUI connector base.

With respect to FIG. 4 there is shown a front view of the micro transceiver 16 including the male AUI connector 14 having the pair of locking posts 28, 30 and male connector pins 13. Corner portions 60 of the upper corners of the base member 58 have been removed to form the guide 62. FIG. 4 also illustrates the upper portion 32A and the lower portion 32B of the enclosure 32. The sliding key 34 is not shown.

One embodiment of the connector latching apparatus includes an electrical switch coupled to the sliding key 34. Sliding the key 34 between the locked and the unlocked positions operates the switch. The switch can be used to provide a status signal which indicates whether the lock is in the locked or in the unlocked position. In the locked position, the status signal will have one level, while in the unlocked position, the status signal will have an opposite level. For example, a logical level "0" may correspond to the unlocked position, while the logical level "1" corresponds to the locked position, or vice versa.

In a specific embodiment, the apparatus is used in conjunction with an Ethernet ® network. The switch is used to set a network response for inquiry by network management software, such as an SNMP ("simple network management") protocol. Alternatively, the switch is used to modify the condition of an Ethernet® signal, such as the XMIT or the RECEIVE or a collision signal. The set network response or the modified signal indicate to the network whether the AUI connector lock 20 is in the locked or in the unlocked position.

In another embodiment, the audible alarm 43 of FIG. 1 is responsive to the switch and will produce an operator alerting tone, for example, a "chirping" sound, when the sliding lock 20 is in the unlocked position.

Figure 5:
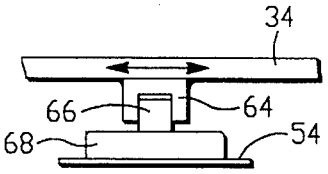
FIG. 5 is a partial pictorial view illustrating an embodiment of the invention having a key operated electrical switch.

In FIG. 5 there is shown an embodiment of the coupled switch. The sliding key 34 includes a member 64 which engages the slide or toggle 66 of an electrical switch 68. The switch 68 is shown mounted upon the circuit card 54 of the micro transceiver 16 of FIG. 3. Sliding the key 34 from side to side between the locked and the unlocked positions operates the switch.

Figure 6:
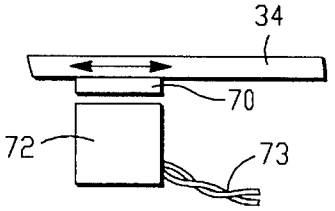
FIG. 6 is a partial pictorial view illustrating an embodiment of the invention having a key operated magnetic switch.

The partial schematic diagram of FIG. 6 illustrates another embodiment of the coupled switch. The sliding key 34 is attached to a magnet 70 which moves from side to side as the key 34 is operated between the locked and the unlocked positions. A Hall-effect device 72 is responsive to the position of the magnet 70 and will produce an output signal on wires 73. The output signal has two levels, one level corresponding to the key 34 being in the locked position, the other level corresponding to the key 34 being in the unlocked position.

Figure 7:
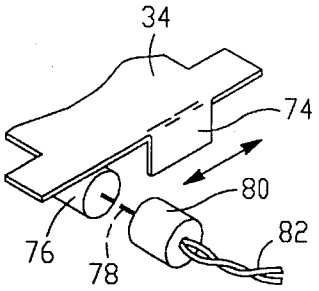
FIG. 7 is a partial pictorial view illustrating an embodiment of the invention having a key operated optical switch.

The partial schematic diagram of FIG. 7 illustrates another embodiment of the coupled switch. The sliding key 34 includes a shutter 74 which moves from side to side as the key 34 is slid from side to side between the locked and the unlocked positions. A light source 76 produces a beam of light 78. A photo detector 80 is responsive to the beam of light 78 and produces an output signal on wires 82. The shutter 74 will allow the beam of light 78 to reach the photo detector 80 when the key 34 is in one position, and will prevent the beam of light 78 from reaching the photo detector 80 when the key 34 is in the other position. The resulting output signal on the wires 82 can be used to indicate whether the key 34 is in the locked or in the unlocked position.

The length of the sliding lock stiffening member 22, as depicted in FIGS. 1 and 2, varies somewhat in female AUI connectors supplied by various manufacturers. In a preferred embodiment, as depicted in FIGS. 8–10, opposed identical members 84, 86 are combined to provide a key 88 having an adjustable width recess 90.

Figure 8:
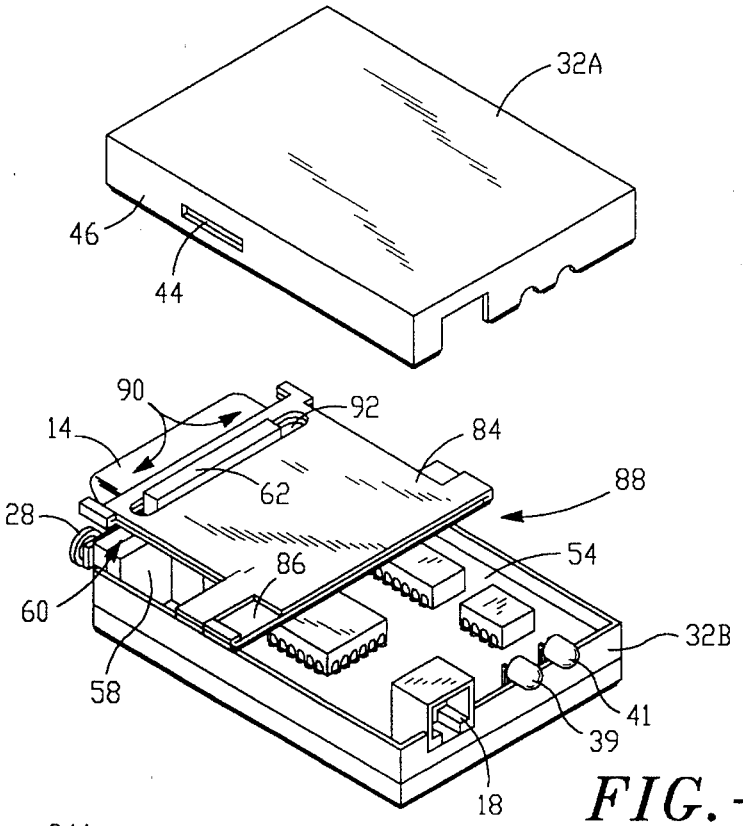
FIG. 8 is an exploded perspective view illustrating an adjustable length key of opposed members according to one embodiment of the present invention.

With particular reference to FIG. 8 there is shown the micro transceiver 16 including the enclosure upper portion 32A, the adjustable length recess key 88, the enclosure lower portion 32B, the circuit card 54, the network connector 18, the LED indicators 39 and 41, and the male AUI connector 14 having guide 62.

The key 88 includes a guide slot 92, similar in function to the guide slot 38 of FIG. 3. When the micro transceiver 16 is assembled, the guide slot 92 fits compatibly over the guide 62 of the male AUI connector 14, as illustrated in FIG. 8. The guide slot 92 is slightly longer than the length of the guide 62, permitting the key 88 to be slid from side to side between the locked and the unlocked positions.

Figure 9:
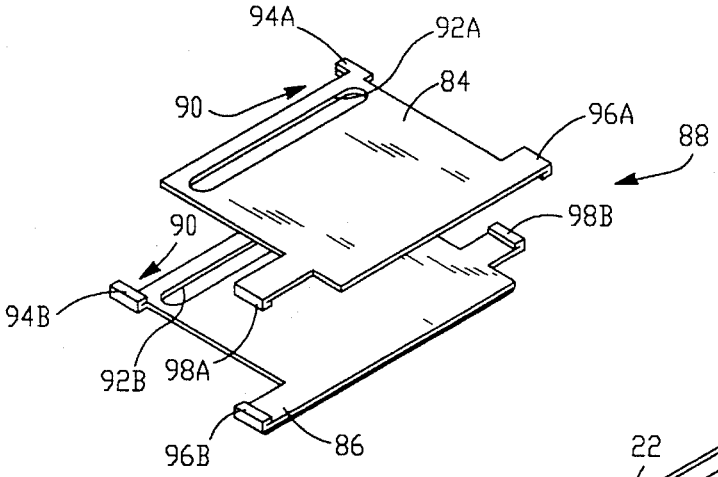
FIG. 9 is an exploded perspective view of the adjustable length key of FIG. 8 showing the opposed members of the adjustable length key.
Figure 10:
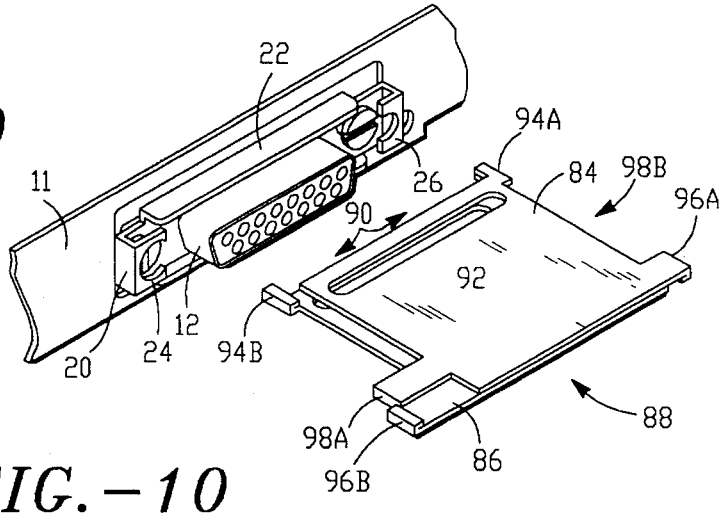
FIG. 10 is a partial perspective view of the key of FIG. 9 showing the key adjusted to mate with a stiffening member of the lock of the female AUI connector.

FIG. 9 is an exploded perspective view illustrating the key 88 made of opposed identical members 84 and 86. The upper member 84 includes a stiffening member engagement tip 94A, a guide slot 92A, an engagement operating tab 96A, and a disengagement operating tab 98A. The lower member 86 is identical with the upper member 84 and has been rotated 180 degrees. The lower member 86 includes a corresponding stiffening member engagement tip 94B, a guide slot 92B, an engagement operating tab 96B, and a disengagement operating tab 98B.

In a preferred embodiment (see FIG. 8) the identical members 84 and 86 are placed in opposition to form the key 88 having a recess 90 of adjustable length. The width and location of the operating tabs 96A,B and 98A, B are selected to form a composite key operating tab. To enlarge the length of the recess 90, the disengagement tabs 98A, B are grasped between thumb and forefinger of one hand. Pressure is applied, causing the identical members 84 and 86 to slide in opposite directions in the plane of the key 88 with respect to one another. As the members 84, 86 slide, the distance separating the engagement tips 94A, B continues to increase until further movement is prevented by interference of the guide 62 with the shortening guide slot 92.

With respect to FIG. 10, there is shown a female AUI connector 12 mounted on a bracket 11 and including a sliding lock 20 having a stiffening member 22. FIG. 10 also illustrates the key 88 made of opposed identical members 84, 86. The length of the recess 90 has been shortened somewhat to match the length of the stiffening member 22. The length of the recess 90 was adjusted by grasping the engagement operating tabs 96A,B between thumb and forefinger of one hand and applying pressure. As the pressure was applied, the opposed identical members 84, 86 moved in opposite directions in the plane of the key 88, causing the engagement tips 94A, B to move closer together.

In practice, the length of the recess 90 is enlarged, as described above, until the recess will accommodate the stiffening member 22 of the mating female AUI connector 12. Then the male and female connectors are mated, and the length of the recess 90 is adjusted to bring the engagement tips 94A, B into contact with opposite ends of the stiffening member 22. Once the key 88 has engaged the stiffening member 22 in this manner, continued pressure between thumb and forefinger against the engagement operating tabs 96A,B is maintained as the entire key 88 is slid from one side to the other, sliding the lock 20 from the unlocked to the locked position. When assembled, the operating tabs 96A, B and 98A, B extend through the slots 44 in opposing sides 46 of the enclosure upper portion 32A.

To unlock the mated connectors, the engagement operating tabs 96A, B are grasped as described above and the key 88 is used to slide the lock 20 to the unlocked position. The unlocked connectors can now be disconnected from one another.

While the foregoing detailed description has described several embodiments of the electrical connector latching apparatus for use with a pair of mating electrical connectors in accordance with this invention, it is to be understood that the above description is illustrative only and not limiting of the disclosed invention. Particularly, the invention is applicable to a variety of interlocking connectors in addition to the AUI connectors of the preferred embodiment. The invention should not be limited to application in an Ethernet® micro transceiver or to the Ethernet® AUI connector specified in the current IEEE 802.3 standard. It will be appreciated that such standards are subject to revision as new networking needs become apparent. It will further be appreciated that variation in the form of the key, including the manner in which the key is supported, the manner in which the key engages the interlock, and the fact that the interlock may be divided into two or more functional elements remain within the scope and spirit of this invention. For example, the key can be supported relative to one or both connectors. Thus the invention is to be limited only by the claims as set forth below.

What is claimed is:

1. An electrical connector latching apparatus for use with a connector for engaging and operating a locking member of a mated connector, the mated connectors defining a locked position and an unlocked position, the locking member being slidable between the two positions, the apparatus comprising:

a key, the key including:

lock engaging means for engaging and sliding the locking member between the locked and the unlocked positions; and support means for slidably disposing the lock engaging means relative to at least one of the connectors.

2. The apparatus as set forth in claim 1, wherein the key defines locked and unlocked positions corresponding to the positions of the locking member of a mated connector and being slidable between the positions, the apparatus further including an electrical switch being coupled to the key, the switch having an on position and an off position, one of the switch positions corresponding to the key being in the locked position, and the other switch position corresponding to the key being in the unlocked position, whereby sliding the key from one position to the other reverses the switch position.

3. The apparatus as set forth in claim 2, wherein the electrical switch comprises a pair of electrical contacts, the contacts completing a circuit when the key is in one position and the contacts interrupting the circuit when the key is in the other position.

4. The apparatus as set forth in claim 2, wherein the electrical switch comprises a light source and a photo-detector and defines a light path therebetween, and having shutter means for interrupting the light path when the key is in one position and not interrupting the light path when the key is in the other position, the photo-detector defining first and second output levels, one output level corresponding to the key being in one position, and the other output level corresponding to the key being in the other position.

5. The apparatus as set forth in claim 2, wherein the electrical switch comprises a Hall-effect device and a magnet having first and second positions relative to the Hall-effect device and defining first and second Hall-effect device output levels, one output level corresponding to the key being in one position, and the other output level corresponding to the key being in the other position.

6. The apparatus as set forth in claim 1, wherein the key defines locked and unlocked positions corresponding to the positions of the locking member of a mated connector and being slidable between the positions, the apparatus further including status indicating means coupled to the key for indicating whether the key is in the locked or the unlocked position.

7. The apparatus as set forth in claim 6, further including the status indicating means providing an electrical signal having first and second levels, one level corresponding to the key being in the locked position and the other level corresponding to the key being in the unlocked position.

8. The apparatus as set forth in claim 6, further including the status indicating means providing first and second visual indications, one visual indication corresponding to the key being in the locked position and the other visual indication corresponding to the key being in the unlocked position.

9. The apparatus as set forth in claim 1, further including an enclosure, the enclosure forming a portion of the support means.

10. The apparatus as set forth in claim 9, further including electronic circuits within the enclosure.

11. The apparatus as set forth in claim 10, further including an electrical connector, the electrical connector making electrical connection with the electronic circuits.

12. The apparatus as set forth in claim 1, wherein the locking member includes a stiffening member and the lock engaging means engages the stiffening member for sliding the locking member between the locked and the unlocked positions, and wherein the stiffening member has a length and the lock engaging means includes an opening for engaging the stiffening member, the opening having adjustable length.

13. The apparatus as set forth in claim 12, wherein the lock engaging means includes opposed sliding means for engaging the stiffening member, the opposed sliding means cooperating to form the opening, the opposed sliding means being slidable with respect to each other for adjusting the length of the opening.

14. The apparatus as set forth in claim 1, wherein the mated connectors are Ethernet® AUI connectors.

15. The apparatus as set forth in claim 14, wherein the AUI connectors are Ethernet® compliant 15-pin D-shell male and female connectors, the female connector including the locking member and the lock engaging means being slidably disposed relative to the male connector.

16. An electrical connector latching apparatus for use with a pair of mating electrical connectors, the connectors including an interlock, the interlock having a locked position for preventing separation of the connectors when mated and having an unlocked position for allowing separation and mating, the interlock being operable between the locked and the unlocked positions, the apparatus comprising:

a key, the key including:

operation means for engaging the interlock and for operating the interlock between the locked and the unlocked positions; and support means for supporting the operation means relative to at least one of the connectors.

17. The apparatus as set forth in claim 16, wherein the key defines locked and unlocked positions corresponding to the positions of the interlock of mated connectors and being slidable between the positions, the apparatus further including an electrical switch being coupled to the key, the switch having an on position and an off position, one of the switch positions corresponding to the key being in the locked position, and the other switch position corresponding to the key being in the unlocked position, whereby sliding the key from one position to the other reverses the switch position.

18. The apparatus as set forth in claim 17, wherein the electrical switch comprises a pair of electrical contacts, the contacts completing a circuit when the key is in one position and the contacts interrupting the circuit when the key is in the other position.

19. The apparatus as set forth in claim 17, wherein the electrical switch comprises a light source and a photo-detector and defines a light path therebetween, and having shutter means for interrupting the light path when the key is in one position and not interrupting the light path when the key is in the other position, the photo-detector defining first and second output levels, one output level corresponding to the key being in one position, and the other output level corresponding to the key being in the other position.

20. The apparatus as set forth in claim 17, wherein the electrical switch comprises a Hall-effect device and a magnet having first and second positions relative to the Hall-effect device and defining first and second Hall-effect device output levels, one output level corresponding to the key being in one position, and the other output level corresponding to the key being in the other position.

21. The apparatus as set forth in claim 16, wherein the key defines locked and unlocked positions corresponding to the positions of the interlock of mated connectors and being slidable between the positions, the apparatus further including status indicating means coupled to the key for indicating whether the key is in the locked or the unlocked position.

22. The apparatus as set forth in claim 16, wherein one of the mating connectors is an Ethernet® AUI male connector for engaging and operating the lock of a mating female AUI connector, and the other mating connector is a mating female AUI connector, and wherein the interlock is the lock.

23. The apparatus as set forth in claim 17, further including circuit means responsive to the switch for setting a network response to indicate whether the interlock is in the locked or in the unlocked position.

24. The apparatus as set forth in claim 17, further including circuit means responsive to the switch for modifying a condition of a network signal to indicate whether the interlock is in the locked or in the unlocked position.

25. The apparatus as set forth in claim 17, further including circuit means responsive to the switch and audible alarm means for sounding an audible alarm when the interlock is in the unlocked position.

26. A key for use with an Ethernet® AUI compliant male connector for engaging and operating the lock of a mating female AUI connector, the lock having locked and unlocked positions, and the lock being slidable along a lock sliding line between the two positions, the key comprising:

a lock engaging member, the member being adapted to compatibly engage the lock, the member being disposed at the male connector for sliding along a line parallel to the lock sliding line; and operation means connected to the lock engaging member for sliding the lock engaging member, whereby, the lock may be slid to the unlocked position, the operation means being operated to slide the lock engaging member into a corresponding position, and the male and the female connectors may then be mated and the lock engaging member engage the lock, the operation means may then be operated to slide the lock engaging member and the engaged lock from the unlocked into the locked position, locking the connectors.

* * * * *